United States Patent [19]

Neuman

[11] 4,365,381

[45] Dec. 28, 1982

[54] CHIMNEY CLEANER

[75] Inventor: Orin E. Neuman, Wittenberg, Wis.

[73] Assignee: Neuman Chimney Cleaners, Inc., Wittenberg, Wis.

[21] Appl. No.: 268,485

[22] Filed: May 28, 1981

[51] Int. Cl.[3] ..... F23J 3/00

[52] U.S. Cl. ..... 15/243; 15/104.18

[58] Field of Search ..... 15/242, 243, 163, 104.18

[56] References Cited

U.S. PATENT DOCUMENTS

| | | | |
|---|---|---|---|
| 1,398,155 | 11/1921 | Rork | 15/243 |
| 1,775,969 | 9/1930 | Neuman | 15/243 |
| 1,847,364 | 3/1932 | Rugard | 15/242 X |

FOREIGN PATENT DOCUMENTS

| | | | |
|---|---|---|---|
| 224883 | 12/1962 | Fed. Rep. of Germany | 15/243 |
| 19952 | 6/1944 | Finland | 15/243 |

*Primary Examiner*—Chris K. Moore
*Attorney, Agent, or Firm*—Nicholas A. Kees

[57] ABSTRACT

An improved chimney cleaner for removing soot from the insides of chimneys. A lower plate is orthogonally connected to a vertical support member. An upper plate, which is the same shape as but smaller than the lower plate, is located over and concentric with the lower plate, so that the vertical support member passes slidably through the upper plate. Cleaning rods are connected to the perimeter of the upper plate, and pass slidably through holes near the perimeter of the lower plate, ending in scraping portions which engage the chimney walls and do the actual soot removal. A support line is attached to the top of the vertical support member, to be pulled by the operator during the cleaning operation. A control line is also attached to the top of the vertical support member. This line is then threaded through an eyelet connected to the upper plate, and held by the operator. When the cleaner becomes snagged on a protrusion on the inside wall, the operator pulls this control line, which forces the upper and lower plates apart, in turn pulling the scraping portions of the cleaning rods inward away fron the protrusion, unsnagging the cleaner.

6 Claims, 6 Drawing Figures

CHIMNEY CLEANER

BACKGROUND OF THE INVENTION

This invention relates to chimney cleaners, and in particular to those chimney cleaners which can be collapsed to save storage space and for ease of use and handling.

Generally, soot build-up in a chimney, whether the fuel be wood, coal, or even oil, can cause serious problems, including fuel waste, and even chimney fires. It follows then that removal of this soot is very important to the health and safety of the persons working and/or living within the building served by the chimney.

In the past, this soot was removed by means of bristle brushes, in the manner of the classic "chimney sweeps" of Victorian England. These bristle brushes wore out relatively quickly on the uneven stone, mortar and brick inside most chimneys, and it was difficult to effectively clean the inside corners of the chimney since most chimneys were and are rectangular or square in cross-section.

Neuman, U.S. Pat. No. 1,775,969, issued Sept. 16, 1930, describes a metal chimney cleaner having cleaning members formed of wire. These cleaning members are attached to the edges of an upper plate, and pass through the edges of a larger concentric lower plate of the same shape. These cleaning members fan outwardly to come in contact with the inside walls of the chimney when the two plates are made to approach each other. A rod attached to the lower plate passes through the upper plate. When the rod is pulled upward, such as by means of a cable, force is applied outwardly on the inside of the chimney walls by the cleaning members. As the upward force on the cable increases, the outward force on the chimney walls increases. Here lies the problem.

As stated above, the inside surfaces of most chimneys are uneven, being made of stone, mortar, brick, etc. Thus if the cleaning members catch on a protrusion, the operator's first reaction will be that a stubborn bit of soot has been encountered, and to pull up more vigorously on the cable. The cleaner will then be lodged in the chimney even more tightly, with no way to dislodge it short of throwing a foreign object down the chimney in an attempt to knock it loose.

This invention relates to solutions to the problems described above.

SUMMARY OF THE INVENTION

The invention includes a center support member fastened to a horizontal plate, which plate is concentric with and larger than an upper plate. The center support member passes through the upper plate and is connected to a support line held by the operator of the chimney cleaner. Metal cleaning rods are attached to the upper plate, and pass through the lower plate. The ends of these rods are shaped so as to be horizontally parallel to the inside walls of the chimney, for even and effective removal of soot. A second line runs from the top of the center support member, down through an eyelet attached to the upper plate, and again up to the operator. Thus when the cleaner becomes lodged in the chimney, the operator simply pulls up on the second rope, forcing the lower plate down with respect to the upper plate, allowing the cleaning members to contract, disloding the cleaner.

An object of the invention is to provide an improved metal chimney cleaner.

Another object of the invention is to provide an improved chimney cleaner which is collapsible for more efficient use of space and greater ease of use.

A more specific object of the invention is to provide an improved chimney cleaner which can be remotely collapsed by pulling on a control line other than the line supporting the weight of the cleaner.

Other objects and advantages of the invention will appear hereinafter.

DESCRIPTION OF THE PREFERRED EMBODIMENT

Figure 2:
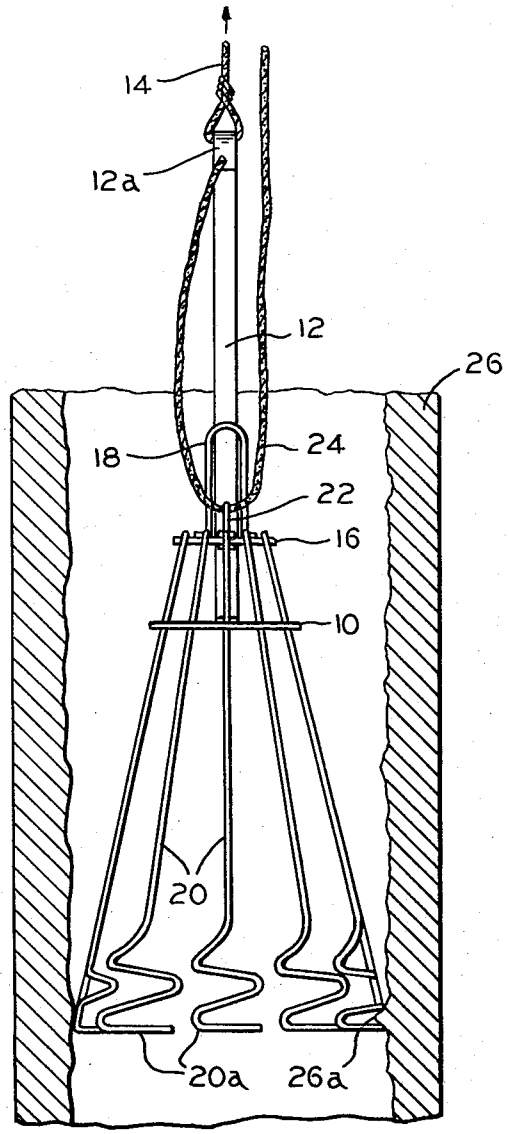
FIG. 2 is a side view of the invention shown within a fragmentary sectional view of a chimney.
Figure 1:
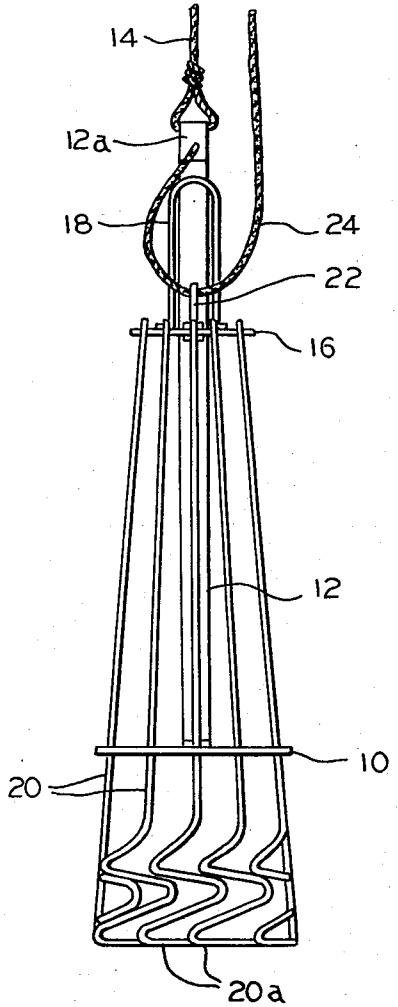
FIG. 1 is a side elevation view of the invention in its collapsed form.
Figure 5:
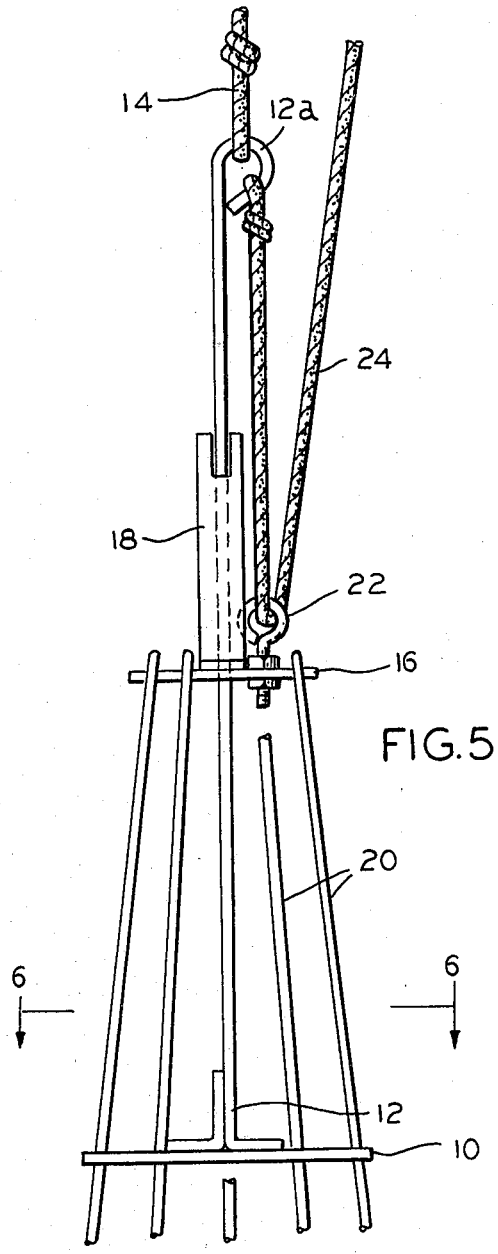
FIG. 5 is an enlarged view along line 5—5 of FIG. 4.
Figure 6:
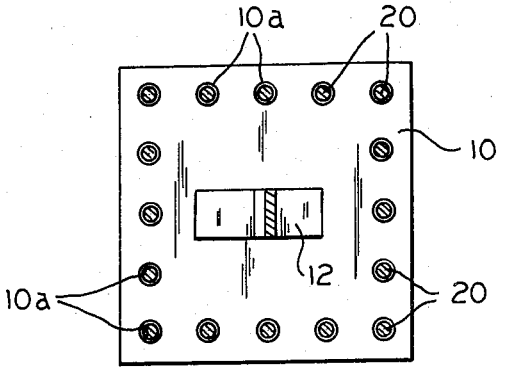
FIG. 6 is a sectional view of FIG. 5 taken along line 6—6.

Referring to FIGS. 1 and 2, the chimney cleaner which is the subject of this invention includes a lower plate 10 secured orthogonally to a vertical support member 12. The upper end of support member 12 is looped as shown in FIG. 5. A support line 14 is then tied through this loop 12*a*, to allow the operator of the chimney cleaner to lower it into the chimney.

Support member 12 passes slidably through an upper plate 16 and through a U-shaped bracket 18 attached to plate 16 for added rigidity. Cleaning rods 20 are pivotably looped through holes near the edge of plate 16 around its entire perimeter, and pass slidably through similar holes 10*a* near the edge of lower plate 10, again around its entire perimeter. The lower ends of rods 20 are scraping portions 20*a*, shaped to form a "z", such that the lowermost portion presents a relatively flat surface to the inside chimney wall for the cleaning thereof.

Figure 4:
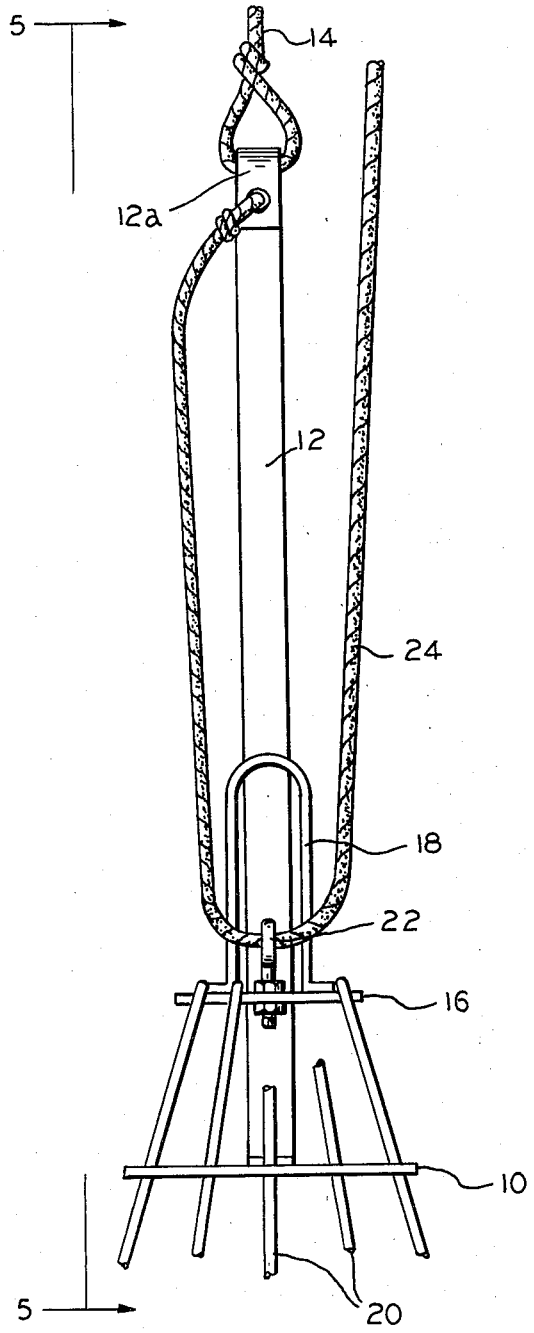
FIG. 4 is an enlarged view of the upper portion of the invention.

As shown in FIGS. 4 and 5, an eyelet 22 is fastened to the upper side of plate 16. One end of a control line 24 is attached to the upper end of support member 12. Control line 24 is then looped down through eyelet 22, and up to the operator. Both support line 14 and control line 24 can be cable, but preferably rope due to its light weight and sufficient strength.

Figure 3:
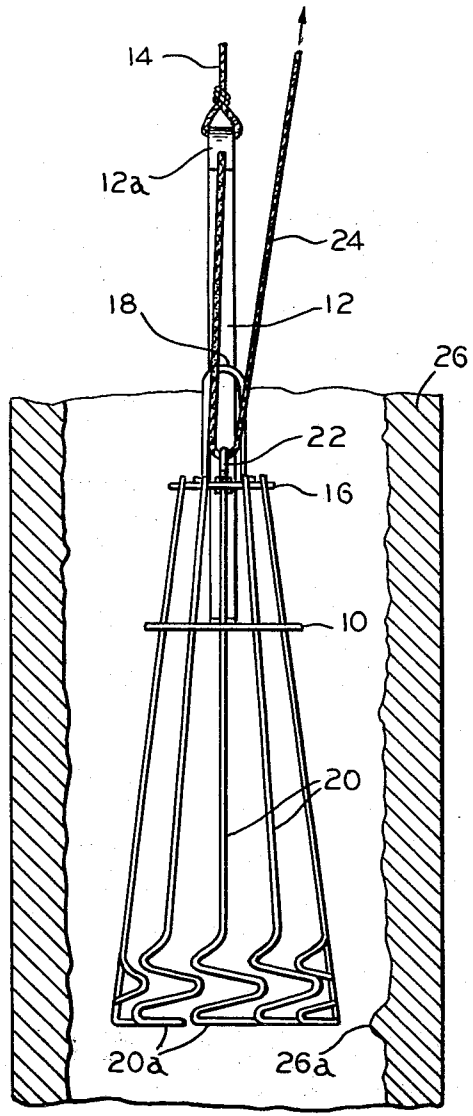
FIG. 3 is a side view of the invention partially collapsed after the control line has been pulled.

The chimney cleaner is shown in operation in FIGS. 2 and 3, cleaning the inside of a chimney 26. In FIG. 2, the operator is pulling upward via vertical support member 12. Since plate 16 and rods 20 are allowed to slide freely with respect to plate 10, gravity and friction on the inside of the chimney walls pulls them downward. Plate 10 is larger than and concentric with plate 16, and so as the two approach each other, the lower ends of rods 20 are forced outward. As the upward force on support line 14 is increased, the downward friction force on rods 20 increases, which in turn forces plates 10 and 16 closer together, increasing the outward force on rods 20. Thus good scraping action is attained.

In FIG. 2, the invention is shown snagged on a protrusion 26*a* on the inside of chimney 26. This protrusion could be a fragment of mortar, the corner of a brick, or some other hard protrusion. To release the cleaner from this snag, control line 24 is pulled up as shown in FIG. 3. This action forces support member 12 and in turn lower plate 10 downward, without lowering upper plate 16. Hence the two plates are separated, pulling cleaning rods 20 together, and releasing the cleaner from the snag. Obviously, then, the need for the person operating the chimney cleaner to use some other tool to reach down the chimney and dislodge it is avoided, since the length of control line 24 between the eyelet 22 and the operator is irrelevant. Thus a remote means of dislodging a snagged cleaner is provided.

While the apparatus hereinbefore described is effectively adapted to fulfill the aforesaid objects, it is to be understood that the invention is not intended to be confined to the particular preferred embodiment of chimney cleaner herein set forth inasmuch as it is susceptible of various modifications without departing from the scope of the appended claims.

What is claimed is:

1. A chimney cleaner for removing soot deposits from the inside walls of chimneys, which walls have protrusions of mortar and the like, comprising:

a vertical support member secured orthogonally at its lower end to a lower plate;

an upper plate having an aperture near its center such that said vertical support member passes slidably through it, said upper plate thus being approximately vertically aligned with, smaller than, and approximately the same shape as said lower plate;

a plurality of rod-like cleaning members looped pivotably through apertures around the perimeter of said upper plate, passing slidably through similar apertures around the perimeter of said lower plate, and ending in z-shaped scraping portions for engagement with the inside chimney walls, such that when said plates are caused to approach each other, said scraping portions are faced outward toward the walls; and means for disengaging said scraping portions of said cleaning members from any snags they may encounter with the protrusions of the inside walls.

2. A chimney cleaner as recited in claim 1 wherein said disengaging means comprises remote means for causing said scraping portions to move together, such that the person operating the chimney cleaner need not use some other tool to dislodge it.

3. A chimney cleaner as recited in claim 2 wherein said remote means comprises a control line, one end of which is held by the operator, and the other end of which is threaded through an eyelet attached to said upper plate, and secured to the upper end of said vertical support member, such that when the operator pulls said control line, said vertical support member is forced downward, moving said lower plate away from said upper plate, in turn causing said scraping portions of said cleaning members to move together, disengaging the cleaner from the snag.

4. An improved chimney cleaner for removing soot deposits from the inside walls of chimneys, which walls have protrusions of mortar and the like having a vertical support member secured orthogonally at its lower end to a lower plate; and upper plate having an aperture near its center such that said vertical support member passes slidably through it, said upper plate thus being approximately vertically aligned with, smaller than, and approximately the same shape as said lower plate; cleaning members looped pivotably through apertures around the perimeter of said upper plate, passing slidably through similar apertures around the perimeter of said lower plate, and ending in scraping portions for scraping the soot from the inside walls, the improvement comprising:

means for disengaging said scraping portions from any snags they may encounter with the protrusions of the inside walls.

5. An improved chimney cleaner as recited in claim 4 wherein said disengaging means comprises remote means for causing said scraping portions to move together, away from the inside walls of the chimney and any protrusions thereon, such that the person operating the chimney cleaner need not use some other tool to disengage it from any snag.

6. An improved chimney cleaner as recited in claim 5 wherein said remote means comprises a control line, one end of which is held by the operator, and the other end of which is threaded through an eyelet attached to said upper plate,and secured to the upper end of said vertical support member;

such that when the operator pulls said control line, said vertical support member is forced downward, moving said lower plate and said upper plate apart, causing said scraping portions to move together, away from the inside walls of the chimney and any protrusion thereon.

* * * * *